United States Patent [19]

Köbler

[11] Patent Number: 4,823,693

[45] Date of Patent: Apr. 25, 1989

[54] PRINTING CYLINDER SLEEVE APPLICATION APPARATUS AND METHOD

[75] Inventor: Ingo Köbler, Anhausen, Fed. Rep. of Germany

[73] Assignee: Man - Roland Druckmaschinen AG, Augsburg, Fed. Rep. of Germany

[21] Appl. No.: 150,089

[22] Filed: Jan. 29, 1988

[30] Foreign Application Priority Data

Jan. 31, 1987 [DE] Fed. Rep. of Germany ..... 3702889

[51] Int. Cl.[4] ..... B41F 27/00

[52] U.S. Cl. ..... 101/218; 101/375; 29/446

[58] Field of Search ..... 101/375, 216, 217, 170, 101/218; 29/446

[56] References Cited

U.S. PATENT DOCUMENTS

| | | | |
|---|---|---|---|
| 2,460,504 | 2/1949 | Huebner | 101/216 X |
| 3,146,709 | 9/1964 | Bass et al. | 101/375 |
| 4,119,032 | 10/1978 | Hollis | 101/375 X |
| 4,697,516 | 10/1987 | Rombout | 101/216 |

FOREIGN PATENT DOCUMENTS

| | | | |
|---|---|---|---|
| 225509 | 6/1987 | European Pat. Off. | 101/375 |
| 470937 | 2/1929 | Fed. Rep. of Germany | 101/375 |
| 2542748 | 4/1976 | Fed. Rep. of Germany | 101/375 |
| 2724653 | 12/1977 | Fed. Rep. of Germany . | |
| 107844 | 7/1982 | Japan | 101/375 |
| 22847 | 6/1976 | United Kingdom . | |

*Primary Examiner*—Clifford D. Crowder

*Attorney, Agent, or Firm*—Frishauf, Holtz, Goodman & Woodward

[57] ABSTRACT

To prevent shifting of an eccentric (12, 33) about a bearing (8, 26), which it surrounds to provide for adjustable positioning of a printing cylinder (3) in a printing machine, upon release of the eccentric from a sidewall (1) of a printing machine to permit placing a sleeve (15) over the cylinder, the eccentric, in accordance with the invention, is locked in position to the shaft of the cylinder, or to the sidewall, or a releasable jaw of the machine prior to release of the eccentric from clamp holding position between holding jaws (13, 27, 28) which, in operation, retain the eccentric in position on the machine.

18 Claims, 4 Drawing Sheets

PRINTING CYLINDER SLEEVE APPLICATION APPARATUS AND METHOD

REFERENCE TO RELATED PATENT PUBLICATION

German Pat. No. 470,937.

The present ivnention relates to an apparatus to apply a sleeve on a printing machine cylinder and more particularly to apply a sleeve which may be a printing form, or a rubber coated sleeve on the printing machine cylinder, to be used in a rotary offset printing machine.

BACKGROUND

Application of sleeves on cylinders located in a printing machine by means of a sleeving apparatus has been previously proposed, see the reference in the German Pat. No. 470,937. An opening is formed in the side wall of the machine, parallel to the axes of rotation of the respective cylinder, to provide access to the cylinder and to permit engagement with the auxiliary sleeving apparatus.

The referenced German Pat. No. 470,937 describes an auxiliary apparatus in which a carrier element, located in one of the sidewalls of the machine lifts the stub shaft of the respective cylinder. The carrier is located in the plane of the sidewall of the machine. The cylinder is suitably supported, and the sleeve is suitably supported parallel to the axis of rotation of the respective cylinder. This, then, permits application of the sleeve over the bearing of the cylinder. The arrangement is designed to be used with an intaglio cylinder. Thereafter, the support is again placed in position to locate the stub shaft bearing, and the auxiliary apparatus can be removed.

The referenced patent is specifically directed to re-sleeving an intaglio cylinder. As is well known, printing cylinders using intaglio printing system need not be shifted in position; they can be located in fixed axial positions in the sidewalls of the printing machine. The web on which printing is to be carried out is pressed by suitable rollers referred to as presser rollers against the intaglio cylinder for printing thereof, as well known.

Various types of printing machines require bearings which can be moved in their position in the sidewalls of the machine, for example, to permit selective application or engagement of a printing cylinder against other cylinders. In such arrangements, it is customary to provide an eccentric, in which the axial stub shaft is located. Arrangements to permit re-sleeving of cylinders which are located on adjustably positionable bearings is not known from the prior art.

THE INVENTION

It is an object to provide an arrangement to apply sleeves on cylinders which are located in sidewalls of the machines in such a manner that the axial position of the cylinder is adjustable, preferably by an eccentric. Arrangements of this type are customary for the forme, and/or rubber blanket or offset cylinders, in raised letter presses, flexo print presses or rotary offset printing machines. It is an additional object to insure that the axial spacing of the cylinder with respect to an adjacent cylinder will not be changed during the re-sleeving operation.

Briefly, an auxiliary sleeving apparatus is provided for carrying the sleeve for application over the cylinder, to which access is provided through an opening in the sidewall of the machine. In accordance with a feature of the invention, the relative rotary position of adjustable bearing holding elements typically eccentrics, with respect to at least one of the sidwalls of the machine is retained, by blocking the shifting or adjusting mechanisms. Thus, upon application of the sleeve on the cylinder, and after release of the adjustment arrangement, or adjustable element from at least one of the sidewalls of the machine, the relative adjusted position with respect to the cylinder in the machine is maintained after application of the sleeve, so that, upon reseating of the cylinder, the prior adjusted position of the adjustable element in the sidewall of the machine is retained.

Preferably, the adjustable element is an eccentric, which can be gripped in position and released by suitable gripping means, which may, for example, be hydraulically or mechanically operated. Various ways to retain the adjustable position of the cylinder can be used, for example, a blocking pin carried on the auxiliary apparatus, or a holding brake on the cylinder shaft itself, which aligns the eccentric on the cylinder shaft. This, of course, presupposes that the cylinder shaft will not rotate, which can be obtained by blocking rotation of the cylinder during the re-sleeving operation, and, for accuracy, even preventing slight shifting of the cylinder due to play in the gearing driving the respective cylinder.

DRAWINGS

DETAILED DESCRIPTION

Figure 1:
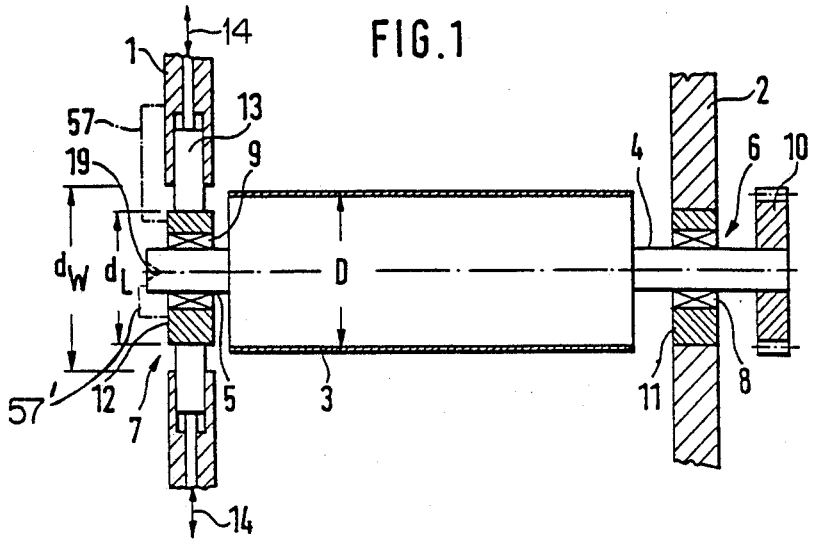
FIG. 1 is a highly schematic longitudinal sectional view through a printing machine cylinder retained on stub shafts in sidewalls of a printing machine, in which adjusted position of the printing cylinder with respect to a reference, not shown, is obtained by eccentrics.

A printing machine has two sidewalls 1, 2 between which a cylinder 3 is located. FIG. 1 illustrates an offset cylinder, having a rubber blanket thereon. The offset cylinder is retained by stub shafts 4, 5 in suitable bearings 8, 9. Offset cylinders have to be engaged against other cylinders for example, a plate cylinder and/or an impression or printing cylinder. In order to permit threading of the paper web, and selective positioning of the offset cylinder, it is necessary to retain the cylinder in the sidewalls 1, 2 of the machine to be movable with respect thereto. Typically, and preferably, the bearings 8, 9 are retained in the sidewall in eccentrics 11, 12, to permit shifting the position of the cylinder 3 with respect to other cylinders which may be considered to define predetermined positions, or reference positions. Upon rotation of eccentrics 11, 12, positioned in openings 6, 7 of the sidewalls 1, 2, the relative position of the cylinder 3 with respect to other cylinders, or a prior reference position can be changed.

The cylinder 3 is driven by a drive gear 10 securely connected to the stub shaft 4. Customarily, the drive gear 10 is a spiral gear. For purposes of illustration, only a single eccentric 11, 12 is shown in each end of the cylinders, that is, for each stub shaft. To provide greater possibilities of adjustments, it is, however, also possible to locate a plurality of eccentrics, for example, two eccentrics within each other. The adaptation of the concept of the present invention to a plurality of eccentrics will be apparent.

At least one of the sidewalls of the printing machines, as illustrated in FIG. 1 of sidewall 1, has an opening 7 having a diameter $d_W$ which is larger than the diameter D of the printing cylinder 3. The diameter $d_L$ of a bushing, or eccentric 11, or a plurality of eccentrics 11 is/are smaller than the diameter D of the cylinder 3.

The arrangement at the side of sidewall 2 can be identical on the sidewall 1. An eccentric corresponding to eccentric 1 or the plurality of eccentrics can retain the respective shaft in suitable position, as well known in printing machine technology. It is, of course, also possible to use all, or portions of the adjustment holding or locking arrangement in accordance with the present invention at the right side of the cylinder 3, with reference to FIG. 1.

In accordance with a feature of the invention, a bearing shell structure 13 is provided in or on the sidewall 1. The bearing shell structure has two bearing shells or bearing shoes or jaws which can be moved in the plane of the sidewall in opposite direction, as schematically illustrated by the double arrows 14 to provide access to the circumference of the cylinder 3 through the opening 7. FIG. 1 illustrates movement of the shoes or the bearing shells in a vertical direction. As will appear, the movement of the bearing shells may well be horizontal, that is, the arrangement at the left side—on FIG. 1—of the cylinder 3 can be rotated 90° in the plane perpendicular to the plane of the drawing.

A sleeve 15 (FIG. 2) can be applied through the opening 7 of the cylinder 3. If the cylinder 3 is a plate cylinder of a rotary offset printing machine, or a forme cylinder of a flexoprint or raised letter print machine, the sleeve 15 will carry the printing impression to be transferred to a printing web, obtained, for example, by chemical treatment to generate the printing impression. If the cylinder 3 is a rubber blanket cylinder, or offset cylinder of a rotary offset printing machine, the sleeve 15 will be coated with, or have a rubber layer applied thereon. This rubber layer, typically, can be applied by vulcanizing the rubber layer on the sleeve 15. The present invention is not limited to the type of sleeve to be applied on the cylinder 3.

Figure 2:
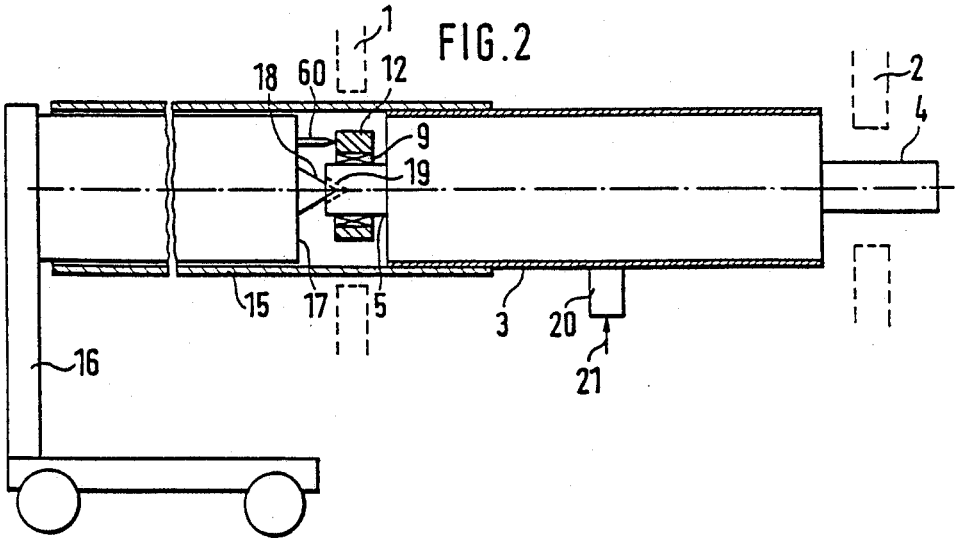
FIG. 2 illustrates an auxiliary sleeving apparatus, in combination with a printing cylinder, and the initiation of a sleeving operation.

An auxiliary apparatus 16 is used to apply the sleeve 15 on the cylinder 3. The auxiliary apparatus 16, for example, in form of a dolly, with suitable wheels, is located in position, concentric with the axis of rotation of the cylinder 3. The auxiliary apparatus 16 carries a cylindrical support 17 on which the sleeve 15, to be applied on cylinder 3, is retained. A holding cone 18 is located at the forward projection of the auxiliary cylinder 17 which, in the simplest form, is a conical tip which engages in a matching conical depression 19 on the stub shaft 5 of the cylinder 3. The dolly 16, with a sleeve 15 on the holder 17 is placed in position against the stub shaft 5, engaging tip 18 in the depression 19. The jaws 13 can then be released and withdrawn beyond the diameter of the sleeve 15. FIG. 2 illustrates the carrier 17 foreshortened, and the sleeve 15 already partly in position on the cylinder 3. If necessary, a temporary support 20 can be placed against the cylinder 3, for example, in form of a half moon or cradle, to provide a holding force 21 to further assist holding the cylinder 3 in position.

In accordance with the present invention, an adjustable positioning element, typically and as shown by the eccentric 12, is secured in position with respect to the circumference of the cylinder which, if retained in angularly adjustable position by the gear 10 will also be circumferentially aligned with the sidewall 2, prior to release of the stub shaft 5, and hence of the bearing 9 and the eccentric 12 upon withdrawal of the jaws 13. Thus, the circumferential position with respect to the reference, which is desired for the shaft position and the radial spacing against one or more adjacent cylinders will be retained.

In accordance with the feature of the invention, it is important that the circumferential position of a sleeve on the bearing 9, or of the eccentric 12 is fixed before the bearing support of the shaft 5 is released. The circumferential position determines the desired shaft position, that is, the shaft radial spacing towards one or more adjacent cylinders. After the circumferential position is fixed, the stub shaft 5 can be released from retention in the side wall 1 and the sleeve can then be applied.

FIG. 1 illustrates, schematically, a circumferential lock by the broken line 57, which circumferentially fixes the position of the eccentric 12. This lock can be obtained by coupling the eccentric 12 prior to movement of the jaws or shoes 13, by a mechanical, magnetic, or other holding and locking arrangement which may, if desired, permit a longitudinal change, by locking the eccentric 12 with respect to a reference position on the side wall 1 of the machine or to the jaws or shoes 13. The broken line 57 also shows, schematically, the flux path if the angular lock of the eccentric is to be carried out magnetically, for example, electromagnetically. This is particularly appropriate if the sleeve 15 to be applied is of non-magnetic material. The lock or holding arrangement to determine the angular position of the eccentric 12 may, of course, also become effective between the shaft 5 and the eccentric 12. Since the cylinder 3 will remain in the machine, and positioned by the eccentric 11, and by gear 10, a lock is illustrated schematically by the double chain dotted line 57'. Such a lock may, for example, be a mechanical brake such as a disc brake or the like.

The locking, or, respectively, retention of circumferential or angular position of the eccentric 12 with respect to a reference insures that the radial spacing of the cylinder 3 with respect to one or more adjacent cylinders will be maintained. After application of the sleeve 15, for example, by pushing it over the cylinder 3, the auxiliary apparatus 16 can be removed in axial direction toward the left in FIG. 2, from the cylinder 3 after, of course, the jaws 13 have been returned to hold the eccentric 12 in position. The locking arrangement 57 can then also be released to permit, if necessary, readjustment of the eccentric 12.

Application of a sleeve 15 over the cylinder 3 is facilitated by slightly expanding the sleeve 15, for example, by forming the cylinder 3 with selected circumferential perforations (not shown) through which compressed air is being emitted to provide a cushion for application of the sleeve 15 on the cylinder 3. The additional support 20, for example, in form of a cradle, can be used, for engagement against the center of the cylinder 3, or any other suitable position, in the direction of the arrow 21 to additionally support the cylinder 3 at the beginning of the sleeving operation, and until the sleeve 15 has been slipped over the cylinder 3 for a distance which reaches the support 20. The use of the support 20 will depend on the specific construction of the dolly 16, the length of the cylinder and the length of the element 17; if the dolly 16 is large and strong enough, the support 20 may not be needed.

Figure 3:
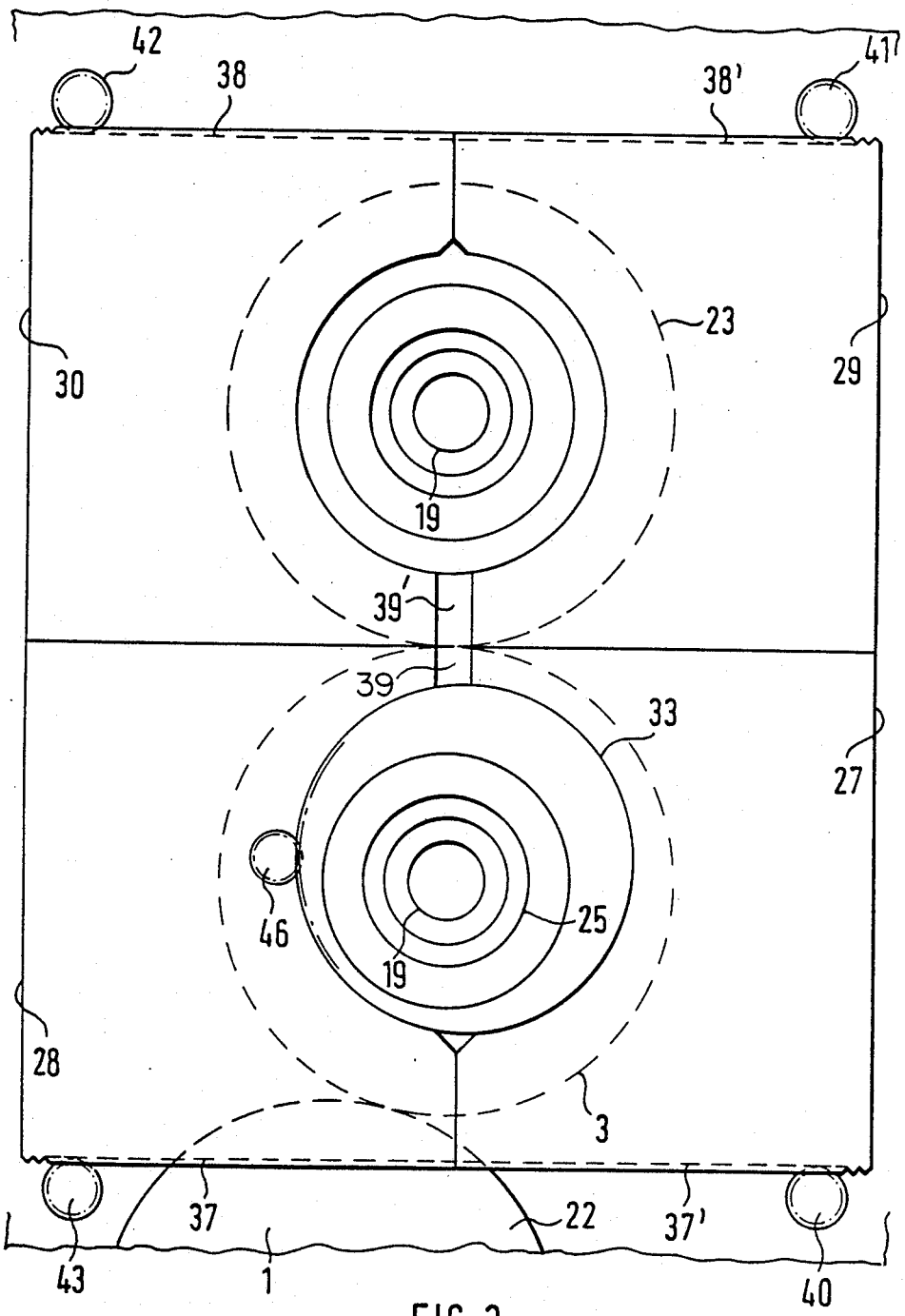
FIGS. 3 and 4 are schematic side views illustrating holding of printing cylinders on which sleeves are to be applied.
Figure 4:
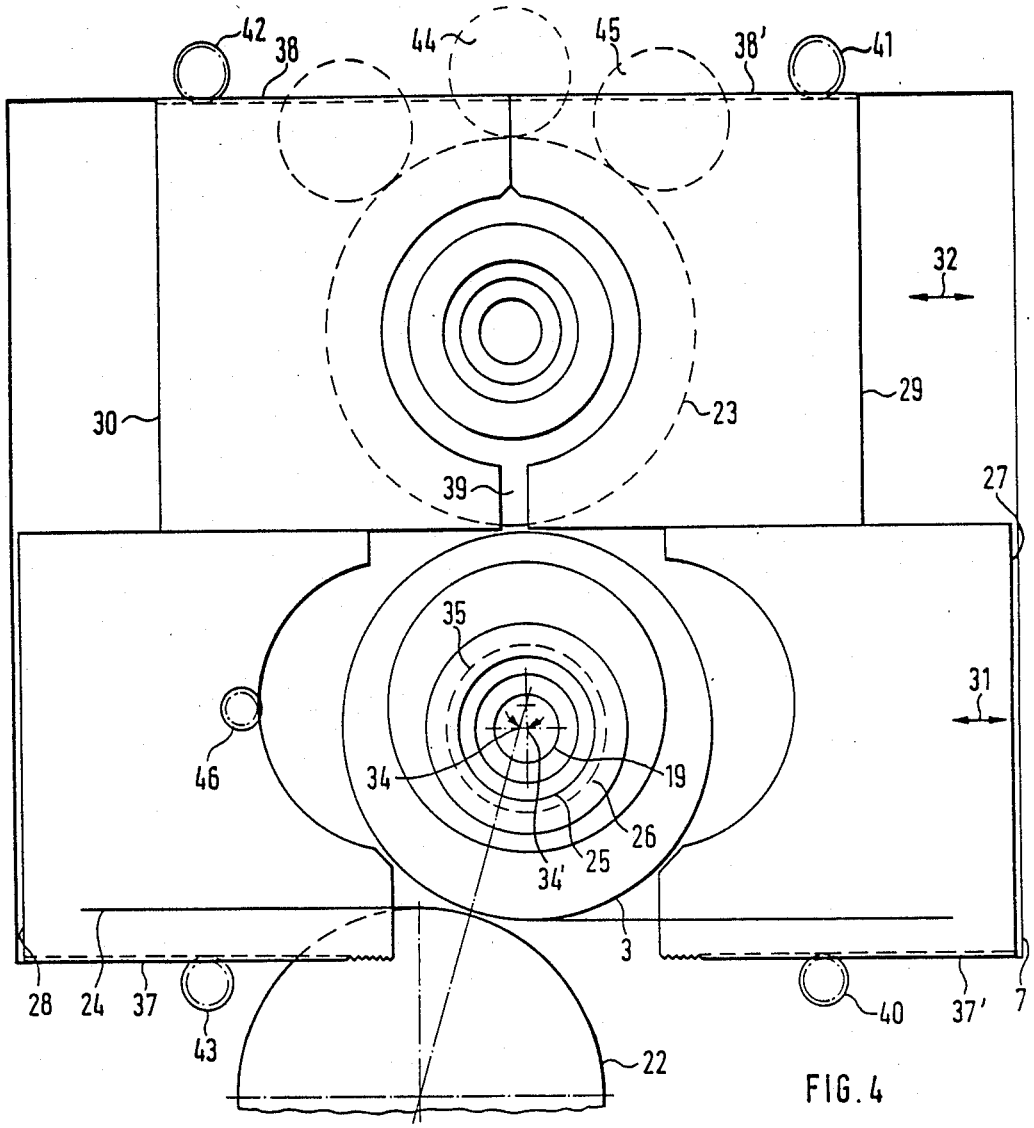
Figure 5:
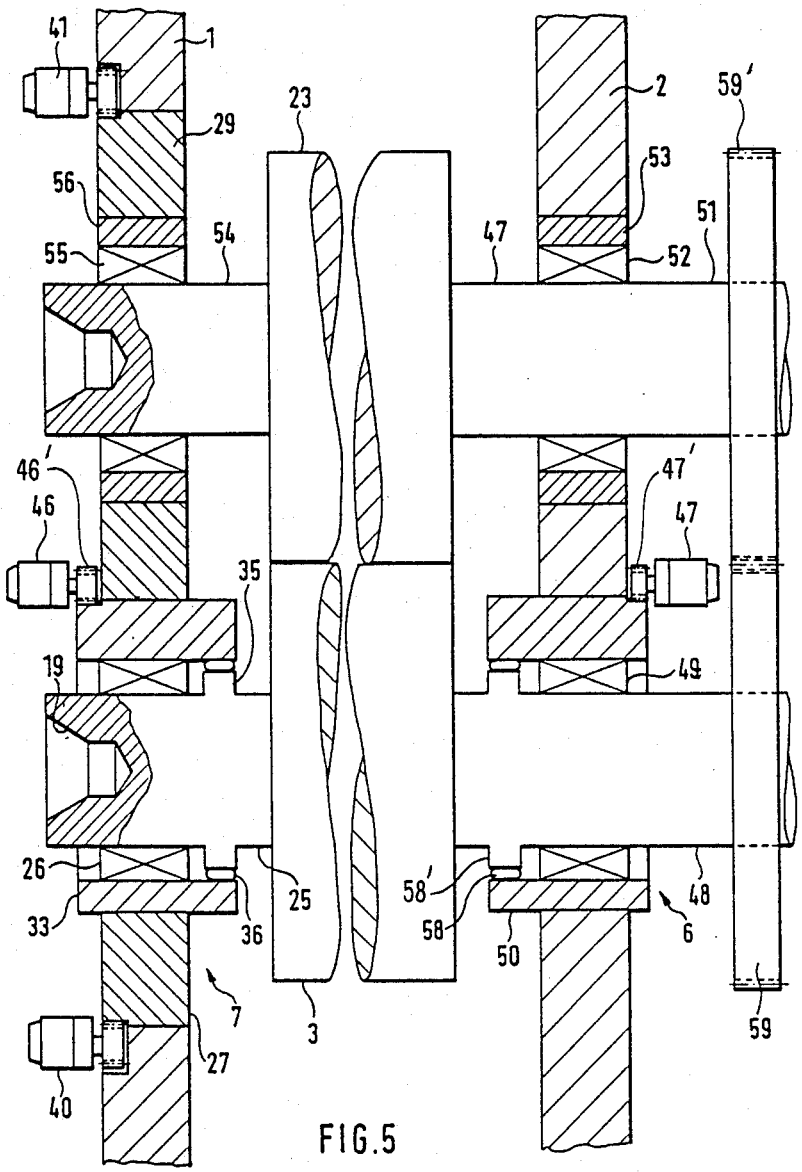
FIG. 5 is a schematic side view of the embodiment shown in FIG. 3, partly in section and partly broken away.

The details of the holding of the cylinder, and an eccentric are shown with reference to FIGS. 3 to 5, applied, by way of example, to a cylinder 3, which is a blanket cylinder of a rotary offset printing machine.

The blanket cylinder 3, shown behind closed jaws 27, 28 in FIG. 3, and visible in end view in FIG. 4, is associated with an impression cylinder 22 and a plate cylinder 23. The offset blanket cylinder 3 can be engaged against the plate cylinder 23 and, if desired, against the impression cylinder 22 by suitable rotation of the eccentric, eccentrically journaling the cylinder 3. Of course, the impression cylinder 22 which, likewise, may be a blanket cylinder, can be similarly retained in eccentrics, or eccentrically adjustable bearings. A substrate web 24, for example, paper or any other material on which printing is to be effected, is shown schematically in FIG. 4, passed between the impression cylinder 22 and the blanket cylinder 3.

Two laterally shiftable jaws 27, 28 are slidably positioned in or on the respective sidewall of the printing machine. The plate cylinder 23, likewise, is retained by slidably shiftable jaws 29, 30. The arrangement can be such that the sidewall is hollowed out to permit lateral shifting; alternatively, the jaws can be located on the surface of the sidewall, and held in position by suitable brackets or rails; the specific type of construction will depend on materials and space availability. The bearing jaws 27, 28 and 29, 30 can be shifted as shown by the double arrows 31 and 32 (FIG. 4). At least one eccentric 33 is located on the stub shaft 25 of the cylinder 3, so that the center of rotation of the cylinder can be shifted as indicated by the center points 34 and 34' in FIG. 4, in which the center 34' shows the disengaged, or removed position from the impression cylinder 22. Similar eccentrics are located on both axial extending shafts of the cylinder, as seen in FIG. 5.

A ring-shaped projection 35 is located on the stub shaft 25 (see FIG. 5) to be engaged by a locking or blocking or braking arrangement in form of a coupling or clutch or brake 36. The coupling or brake or clutch 36 which is releasable, is active against an inner bore, inwardly extended, of the eccentric 33. Thus, when the brake or coupling 35, 36 is rendered effective, the eccentric 33 is locked with respect to ring 35 on the stub shaft 25. Such locking of the eccentric, in accordance with a feature of the invention, is carried out before the jaws 27, 28 are released, that is, before the stub shaft 25 is freed from restrained positioning in the sidewall. Preferably, jaws 27, 28 for cylinder 3, and jaws 29, 30 for the plate cylinder 23 are shifted in opposite directions by gears 40, 43 and 41, 42, respectively, engaging in rack gearing at the edges of the respective jaws 27, 28 and 29, 30. This permits ready simultaneous shifting of the respective jaws. The jaws, of course, are separated along a separating line. At the engaging sides of the respective jaws, separating gaps 39, 39' are preferably formed.

In the example selected and as shown in FIGS. 3–5, only the central cylinder 3 of the three-cylinder printing system is eccentrically retained; the plate cylinder 23 is centrally held in position. It is often necessary only to have one of the engaged cylinders eccentrically positioned; the axial position of the plate cylinder is not changed. Of course, the plate cylinder, similar to the cylinder 3 may likewise be supplied with an eccentric and, upon removing the cylinder 3 from engagement with cylinder 23, a suitable sleeve can be applied on the cylinder 23. FIG. 4 illustrates, schematically, additional rollers 44, 45, engaged against the plate cylinder and schematically showing application rollers, for example, of suitable inkers and dampeners. Since these do not form part of the present invention, they are shown in broken lines.

In accordance with the preferred feature of the invention, the cylinder 3 should be locked in position when the sleeve is to be applied; thus, the other side of the cylinder 3, that is, the right side in FIG. 5, and adjacent the sidewall 2 should be locked in circumferential position. This prevents rotation of the stub shaft 48 (FIG. 5) in the bearing 49 in which the eccentric 50 is located, due to play in the gears driving the cylinders 3 and 23. This play can be considerable when the machine is not in operation. To lock the circumferential position of the cylinder 3 with respect to the sidewall, the stub shaft 48 is formed with a radial ring 58', similar to the ring 35, which can be engaged by a brake or clutch 58, effective against an inner projecting flange of the eccentric 50. Since the eccentric 50 is secured in position in the sidewall 2, the circumferential position of the cylinder 3 is fixed.

The cylinders are heavy; to adjust the position of the eccentrics 33 and 50, gear elements 46', 47' which, preferably, are driven by motors 46, 47 engage circumferential gears formed on the respective eccentrics 33, 50. This readily permits engaging and disengaging the cylinders, and shifting their relative axial position. The motor 46 can be secured to the jaw 28, as seen in FIG. 4, so that the motor and the gear 46' is released together with the jaw. The illustration of FIG. 5 is rotated by 90° with respect to the showing of FIGS. 3 and 4. In FIG. 5 the attachment of the motor 46 to the jaw 28 has been omitted, since any suitable bracket may be used.

The plate cylinder 23 (FIG. 5) is retained in position by stub shafts 51, 54 in bearings 52, 55, located in bearing bushings 53, 56 which can be concentric to the axis of rotation of plate cylinder 23. Bushing 56 is located between jaws 29, 30, so that, upon retraction of the jaws, the plate cylinder 23 will be accessible and can be supplied with a sleeve.

The cylinders 3, 23 are driven as well known in standard and printing machine technology by gears 59, 59', secured to the respective stub shafts 48, 51.

The eccentric 12 can be attached to the side wall 1 of the printing machine or, for angular or circumferential locking, can be attached to the respective shoes or jaws 13. If so, the eccentric should have a two- or multi-part construction. In the embodiment illustrated, a two-part jaw or shoe construction 13 is used. If the eccentric 12 then is also a two-part element, then, for example, the upper half of the eccentric can be coupled to the upper jaw or shoe 13 and the lower half of the eccentric to the lower corresponding shoe. The attachment may be magnetically, by a brake, or by an engageable and releasable screw connection, for example. The eccentric parts 12 can also be guided radially outwardly secured to the side wall 1, of course before the sleeve 15 (FIG. 2) is fitted on the cylinder 3.

The eccentric can also be secured in relative position with respect to the shaft of the cylinder 3 by a holding arrangement secured to the auxiliary apparatus 16. FIG.

2 illustrates positioning of the eccentric 12 by a blocking element 60, for example, in form of a projecting pointed pin, engaging the eccentric 12 to prevent its rotary shifting about the bearing 9. Upon engagement of the dolly with the cylinder 3, and prior to the application of sleeve 15 over the cylinder 3—as seen in FIG. 2—the eccentric 12 is held in position so that, after release of the jaws 13, the eccentric 12 cannot shift about the bearing 9. Preferably, the pointed pin 60 engages in matching depressions formed in the outside of the eccentric 12 to provide for an interengaging positive lock. Friction or brake elements may also be used.

In the embodiment of FIG. 2, it is not necessary to divide the eccentric into two or more parts, since the locking element or pin 60 locks the eccentric on the bearing 9, so that it cannot rotate about the bearing, and thus shift its position with respect to the shaft 5. Consequently, the eccentric will be circumferentially, or angularly locked. As described in connection with FIGS. 3 to 5, it is of course also possible to directly lock the eccentric 12 on the stub shaft 5.

The holding element 57 may be an electromagnetic arrangement which holds the eccentric parts or the eccentric in position, for example, against the jaws 27 or with respect to the side wall 1.

Various changes and modifications may be made, and features described in connection with any one of the embodiments may be used with any of the others, within the scope of the inventive concept.

I claim:

1. In combination wit a printing machine, a printing cylinder sleeve application apparatus (16) to apply a cover sleeve (15) on a printing cylinder (3,22, 23) retained by stub shafts in bearing means in the printing machine without disassembly of the cylinder from the printing machine;

wherein the printing machine includes tow sidewalls (1, 2);

said bearing means (8, 9; 46,49; 52, 55) rotatably retaining the printing cylinder (3, 22, 23) in the machine;

adjustable positioning means (33) surrounding said bearing means and adjustably retaining said bearing means in said sidewalls of the machine to control the position of the printing cylinder in the machine;

means (13, 14; 27, 28) releasably securing the adjustable positioning means in the sidewalls of the machine, and wherein at least one of the sidewalls of the machine is formed with an opening (7) in alignment with the printing cylinder, said sleeve application apparatus (16, 17) comprising means for carrying said sleeve (15) for application of said sleeve over the printing machine cylinder, and means for supporting the cylinder on the side adjacent said opening (7), after release of the adjustable positioning means from the sidewall of the machine, and means (57, 35, 36, 60) for maintaining and locking the relative position of the adjustable positioning means (12, 33), with respect to a predetermined reference position after release of the adjustable positioning means from the at least one sidewall of the machine and during application of said sleeve on the cylinder for maintaining the relative adjusted position of said cylinder in the machine after application of said sleeve and after re-securing the adjustable positioning means in the at least one sidewall while maintaining said bearing means and eccentric means in place on the cylinder ends said bearing means and adjustable positioning means remaining on said printing cylinder stub shafts during said sleeve application.

2. The combination of claim 1, wherein said positioning means comprises eccentric means (12,33) surrounding an adjacent bearing means (9, 26) and said position maintaining and locking means retain the eccentric means (12, 33) against rotation about the associated bearing means from the predetermined reference position.

3. The combination of claim 2, further including releasable holding jaws (13, 27, 28) secured to one of the sidewalls of the machine adjacent said eccentric means, and retaining said eccentric means in said predetermined reference position.

4. The combination of claim 2, wherein said position maintenance and locking means comprises engageable locking elements (35, 36), respectively coupled to said eccentric means (12, 33) and to the respective printing cylinder.

5. The combination of claim 4, wherein said engageable locking elements comprise clutch or brake elements located, respectively, between said eccentric means (33) and a shaft element (25) coupled to the respective printing cylinder (3).

6. The combination of claim 4, further including separable holding jaws or shoes (13, 27, 28) coupled for movement towards and away from each other parallel to the sidewall of the machine, and, selectively, clamping the eccentric means in position or releasing the eccentric means, said jaws or shoes, when separated from each other, permitting access for the sleeve (15) through said opening (17) in the sidewall of the machine and application of said sleeve on the respective cylinder.

7. The combination of claim 6, wherein said jaws or shoes (13, 27, 28) are formed with gear or rack means;

and gearing means (40, 43) engageable with said gear or rack means for conjoint shifting of the jaws or shoes in opposite direction.

8. The combination of claim 6, wherein the eccentric is formed with an external gearing;

and gear drive means (46, 46') engageable with said external gearing , and secured to one of said jaws or shoes for rotating the eccentric, to shift the center of the axis of rotation of the respective cylinder with respect to said reference position.

9. The combination of claim 4, wherein the eccentric means is formed with a ring-shaped extension overlapping at least a portion of said stub shaft;

and wherein said locking elements comprise brake or clutch elements locking said stub shaft to an inner wall of said ring-shaped extension of the eccentric means.

10. The combination of claim 2, wherein one (1) of said sidewalls (1, 2) is formed with said opening (7);

a second eccentric means (50) is positioned in the sidewall which does not have said opening (7) formed therein;

and a second position maintenance and locking means (57', 58) is provided adjacent said second eccentric means to lock the cylinder (3) in predetermined fixed rotary position;

and a drive gear (59) secured to said stub shaft adjacent said second eccentric.

11. The combination of claim 2, wherein said position maintaining and locking means comprises a magnetic locking means (57) magnetically maintaining the position of the eccentric means (12, 33) with respect to the predetermined reference position.

12. The combination of claim 1, wherein the cylinder (3) comprises an offset cylinder.

13. The combination of claim 1, wherein the sleeve applying apparatus comprises a movable dolly (16);

a cylindrical support element (17) secured to the dolly and positionable in axial alignment with the printing machine cylinder (3), said cylindrical support element retaining the sleeve (15) thereon;

and a shaft engagement and support arrangement, fitting a shaft extension (5) of the printing machine cylinder for engagement and support of said shaft extension.

14. The combination of claim 13, wherein the position maintaining and locking means comprises an engagement element secured to said dolly, and engageable with said adjustable positioning means to lock said adjustable positioning means in position.

15. The combination of claim 14, wherein said adjustable positioning means comprises eccentric means (12, 33) surrounding an adjacent bearing means (9, 26) and said position maintaining and locking means retain the eccentric means (12, 33) against rotation about the associated bearing means from said reference position.

16. A method of applying a sleeve (15) on a cylinder (3, 22,23) of a printing machine, wherein the cylinder is retained in the printing machine in bearing means at the cylinder ends (8, 9; 26, 49; 52, 55);

eccentric means (12, 33) surround selected ones of said bearing means to retain said bearing means, and hence the printing cylinder in a predetermined position in the machine, and including holding means (13, 28) holding the eccentric means in position on the machine, comprising the steps of locking the eccentric means in the predetermined position prior to release of the holding means to prevent rotation of the eccentric means about the bearing means upon release of the holding means;

releasing the holding means;

applying the sleeve (15) over the cylinder (3) while maintaining said bearing means and eccentric means in place on the cylinder ends;

re-engaging the holding means on the eccentric means, whereby the previously established position of the cylinder with respect to the predetermined position will be maintained; and unlocking the eccentric means.

17. The method of claim 16 wherein the locking step comprises fixing the angular portion of the eccentric means with respect to a sidewall of the machine.

18. The method of claim 16, wherein the locking step comprises fixing the angular portion of the eccentric means with respect to the cylinder (3, 22, 23).

* * * * *